US007966980B2

(12) United States Patent
Lee et al.

(10) Patent No.: US 7,966,980 B2
(45) Date of Patent: Jun. 28, 2011

(54) VARIABLE COMPRESSION RATIO APPARATUS

(75) Inventors: Eun Ho Lee, Hwaseong (KR); Jei Choon Yang, Yongin (KR); Young Hong Kwak, Suwon (KR); Kiyoung Kwon, Seoul (KR); Jin Kook Kong, Suwon (KR); Soo Hyung Woo, Yongin (KR); Young Jin Won, Hwaseong (KR)

(73) Assignee: Hyundai Motor Company, Seoul (KR)

( * ) Notice: Subject to any disclaimer, the term of this patent is extended or adjusted under 35 U.S.C. 154(b) by 602 days.

(21) Appl. No.: 12/133,496

(22) Filed: Jun. 5, 2008

(65) Prior Publication Data

US 2009/0139492 A1 Jun. 4, 2009

(30) Foreign Application Priority Data

Nov. 29, 2007 (KR) ..... 10-2007-0122818

(51) Int. Cl.
*F02B 75/04* (2006.01)

(52) U.S. Cl. ..... 123/48 B; 123/78 F

(58) Field of Classification Search ..... 123/48 B, 123/78 BA, 78 E, 78 F
See application file for complete search history.

(56) References Cited

U.S. PATENT DOCUMENTS 4,517,931 A * 5/1985 Nelson ..... 123/48 B

* cited by examiner

*Primary Examiner* — Noah Kamen
(74) *Attorney, Agent, or Firm* — Morgan, Lewis & Bockius LLP

(57) ABSTRACT

A variable compression ratio apparatus that changes the compression ratio of an air-fuel mixture in a combustion chamber according to a driving state of an engine, enablements may include a connecting rod receiving the combustion force from the piston; a pin link receiving a part of the combustion force from the connecting rod and rotating the crankshaft; a support link disposed substantially in parallel with the connecting rod; a division link receiving a part of the combustion force from the connecting rod and transmitting the part of the combustion force to the support link; a control link provided with one end coupled to the division link in order to change position of one end of the division link; and an eccentric camshaft coupled to other end of the control link in order to change position of a rotational axis of the control link.

20 Claims, 7 Drawing Sheets

VARIABLE COMPRESSION RATIO APPARATUS

CROSS-REFERENCE TO RELATED APPLICATION

This application claims priority to and the benefit of Korean Patent Application No. 10-2007-0122818 filed in the Korean Intellectual Property Office on Nov. 29, 2007, the entire contents of which are incorporated herein by reference.

BACKGROUND OF THE INVENTION (a) Field of the Invention

The present invention relates to a variable compression ratio apparatus. More particularly, the present invention relates to a variable compression ratio apparatus that changes the compression ratio of an air-fuel mixture in a combustion chamber according to a driving state of an engine.

(b) Description of the Related Art

Generally, a variable compression ratio apparatus changes the compression ratio of an air-fuel mixture according to a driving state of an engine. Such a variable compression ratio apparatus includes a pin link connecting a crankshaft with a piston, a control link changing a trace of the pin link, and an eccentric camshaft changing position of a rotational axis of the control link. Traces of the pin link and the connecting rod are changed by changing position of the rotational axis of the control link and as a result, the volume of the combustion chamber and the compression ratio of the air-fuel mixture are changed.

According to a conventional variable compression ratio apparatus, the control link is disposed vertically under the crankshaft or is disposed horizontally next to the crankshaft. Therefore, the volume of the crankcase may increase.

In addition, since the combustion force is directly transmitted to the connecting rod, the pin link, and the control link, materials may need to be changed or the size of respective components may need to be increased so as to increase the durability of respective components. Therefore, manufacturing costs may increase.

The above information disclosed in this Background section is only for enhancement of understanding of the background of the invention and therefore it may contain information that does not form the prior art that is already known in this country to a person of ordinary skill in the art.

SUMMARY OF THE INVENTION

Embodiments of the present invention provide a variable compression ratio apparatus having advantages of reducing the maximum stress that is applied to respective links by dividing the combustion force received from a piston and applying the divided combustion force to a pin link.

In addition, embodiments of the present invention have been made in an effort to provide a variable compression ratio apparatus having further advantages of being mounted in a crankcase without increasing the size of the crankcase.

A variable compression ratio apparatus according to an exemplary embodiment of the present invention may be mounted at an engine receiving a combustion force of an air-fuel mixture from a piston and rotating a crankshaft, and may change the compression ratio of the air-fuel mixture.

Such an embodiment of a variable compression ratio apparatus may include: a connecting rod receiving the combustion force from the piston; a pin link receiving the combustion force from the connecting rod and rotating the crankshaft; a support link disposed substantially in parallel with the connecting rod in order to transmit a part of the combustion force to the pin link; a division link receiving a part of the combustion force from the connecting rod and transmitting the part of the combustion force to the support link; a control link provided with one end coupled to the division link in order to change position of one end of the division link; and an eccentric camshaft coupled to other end of the control link in order to change a position of a rotational axis of the control link.

The eccentric camshaft may change the compression ratio and exhaust amount of the air-fuel mixture by changing the vertical position of the other end of the control link.

The control link may be disposed substantially vertically next to the crankshaft.

The compression ratio and the exhaust amount of the air-fuel mixture may be changed by changing the length and shape of the division link and the support link.

The control link and the division link may be integrally formed with each other to be a single body.

The eccentric camshaft may be provided with an eccentric cam which rotation is controlled by an engine control unit.

In another exemplary embodiment of the present invention, a variable compression ratio apparatus that is mounted at an engine receiving a combustion force of an air-fuel mixture from a piston and rotating a crankshaft, and that changes compression ratio of the air-fuel mixture, may comprise: a pin link provided with first, second, and third connecting points, the first connecting point being eccentrically and rotatably coupled to the crankshaft; a connecting rod provided with two ends and a middle portion, one end thereof being rotatably coupled to the second connecting point of the pin link, and other end thereof being rotatably coupled to the piston; a support link provided with two ends, one end thereof being rotatably coupled to the third connecting point of the pin link; a division link provided with two ends and a middle portion, one end thereof being rotatably coupled to the middle portion of the connecting rod and the middle portion thereof being rotatably coupled to other end of the support link in order to transmit a part of the combustion force to the pin link; a control link provided with two ends, one end thereof being rotatably coupled to other end of the division link; and an eccentric camshaft coupled to other end of the control link in order to change position of a rotational axis of the control link.

The eccentric camshaft may change the compression ratio and exhaust amount of the air-fuel mixture by changing the vertical position of the other end of the control link.

The first, second, and third connecting points may be disposed in a predetermined triangular shape.

The support link may be disposed substantially in parallel with the connecting rod.

The control link may be disposed substantially vertically next to the crankshaft.

The compression ratio and the exhaust amount of the air-fuel mixture may be changed by changing the length and shape of the division link and the support link.

The eccentric camshaft may be provided with an eccentric cam which rotation is controlled by an engine control unit.

In further another exemplary embodiment of the present invention, a variable compression ratio apparatus that is mounted at an engine receiving a combustion force of an air-fuel mixture from a piston and rotating a crankshaft, and changes compression ratio of the air-fuel mixture, may comprise: a pin link provided with first, second, and third connecting points, the first connecting point being eccentrically and rotatably coupled to the crankshaft; a connecting rod provided with two ends and a middle portion, one end thereof being rotatably coupled to the second connecting point of the pin link, and other end thereof being rotatably coupled to the piston; a support link provided with two ends, one end thereof being rotatably coupled to the third connecting point of the pin link; a division link provided with two ends, one end thereof being rotatably coupled to the middle portion of the connecting rod, other end thereof being rotatably coupled to other end of the support link in order to transmit a part of the combustion force to the pin link; a control link provided with two ends, one end thereof being integrally formed with the other end of the division link; and an eccentric camshaft coupled to other end of the control link in order to change position of a rotational axis of the control link.

The eccentric camshaft may change the compression ratio and exhaust amount of the air-fuel mixture by changing the vertical position of the other end of the control link.

The first, second, and third connecting points may be disposed in a predetermined triangular shape.

The support link may be disposed substantially in parallel with the connecting rod.

The control link may be disposed substantially vertically next to the crankshaft.

The compression ratio and the exhaust amount of the air-fuel mixture are changed by changing the length and shape of the division link and the support link.

The eccentric camshaft may be provided with an eccentric cam which rotation is controlled by an engine control unit.

Figure 1:
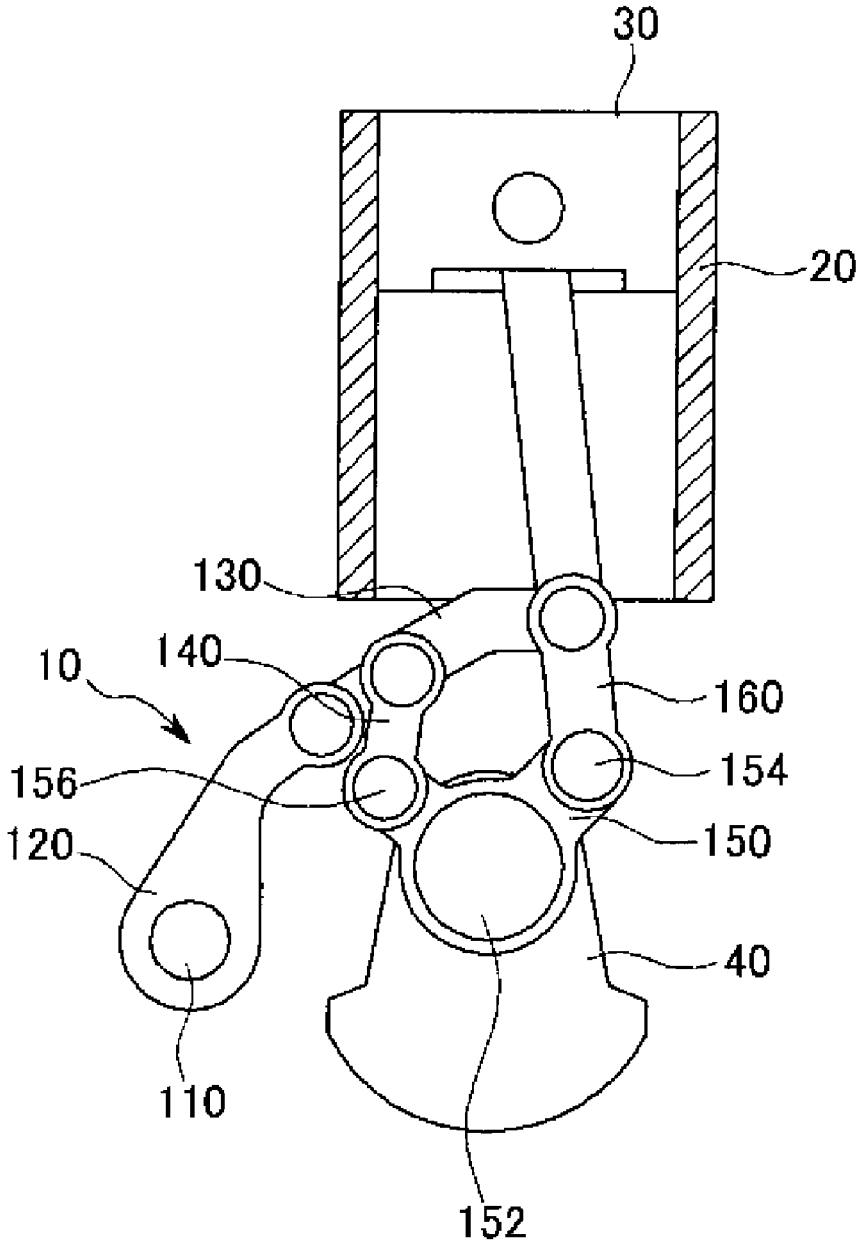
FIG. 1 is a schematic diagram of a variable compression ratio apparatus according to an exemplary embodiment of the present invention.

In the figures, reference numbers refer to the same or equivalent parts of the present invention throughout the several figures of the drawing.

DETAILED DESCRIPTION OF THE EMBODIMENTS

Hereinafter reference will now be made in detail to various embodiments of the present invention, examples of which are illustrated in the accompanying drawings and described below. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

As shown in FIG. 1, a variable compression ratio apparatus 10 according to an exemplary embodiment of the present invention is mounted at an engine (not shown) that receives combustion force of an air-fuel mixture from a piston 30 and rotates a crankshaft 40, and changes the compression ratio of the air-fuel mixture.

The piston 30 moves upwardly or downwardly in a cylinder 20, and combustion chamber is formed between the piston 30 and a cylinder head (not shown).

The crankshaft 40 receives the combustion force from the piston 30, changes the combustion force into torque, and transmits the torque to a transmission (not shown).

The variable compression ratio apparatus 10 includes a connecting rod 160, a pin link 150, a support link 140, a division link 130, a control link 120, and an eccentric camshaft 110.

The connecting rod 160 receives the combustion force from the piston 30 and transmits the combustion force to the pin link 150. The connecting rod 160 includes two ends and a middle portion. One end of the connecting rod 160 is rotatably coupled to the pin link 150, and the other end of the connecting rod 160 is rotatably coupled to the piston 30.

The pin link 150 receives the combustion force from the connecting rod 160 and the support link 140, and rotates the crankshaft 40. The pin link 150 includes first, second, and third connecting points 152, 154, and 156.

The first connecting point 152 is eccentrically and rotatably coupled to the crankshaft 40, the second connecting point 154 is rotatably coupled to one end of the connecting rod 160, and the third connecting point 156 is rotatably coupled to the support link 140. The first, second, and third connecting points 152, 154, and 156 are disposed in a predetermined triangular shape, and the predetermined triangular shape can be easily determined according to a target engine performance by a person of ordinary skill in the art.

The support link 140 transmits a part of the combustion force to the pin link 150, and includes two ends. One end of the support link 140 is rotatably coupled to the third connecting point 156 of the pin link 150, and other end of the support link 140 is rotatably coupled to a portion of the division link 130. In an exemplary embodiment of the present invention, the support link 140 may be disposed substantially in parallel with the connecting rod 160 so as to transmit a part of the combustion force to the pin link 150.

As described above, since a part of the combustion force is transmitted to the crankshaft 40 through the support link 140 and the remaining part of the combustion force is transmitted to the crankshaft 40 through the connecting rod 160, maximum stress applied to the connecting rod 160 and the support link 140 may be reduced.

The division link 130 receives the part of the combustion force from the connecting rod 160, and transmits the part of the combustion force to the support link 140. The division link 130 includes two ends and a middle portion. One end of the division link 130 is rotatably coupled to the middle portion of the connecting rod 160, the middle portion of the division link 130 is rotatably coupled to other end of the support link 140, and other end of the division link 130 is rotatably coupled to the control link 120.

The control link 120 includes two ends. One end of the control link 120 is rotatably coupled to the other end of the division link 130, and other end of the control link 120 is rotatably coupled to the eccentric camshaft 110. Rotational axis 180 of the control link 120 is co-axially positioned at the eccentric camshaft 110. Accordingly, the position of the rotational axis 180 is changed by controlling the position of the eccentric camshaft 110 such that traces of the links 130, 140, and 150 and the connecting rod 160 can be changed altogether.

In addition, the control link 120 is disposed substantially vertically at the left side of the crankshaft 40 in the drawing. Therefore, a volume change of the crankcase according to the length of the control link 120 may be minimized. The control link 120 and the eccentric camshaft 110 may be disposed at the right of the crankshaft 40 in another example.

The eccentric camshaft 110 changes position of the rotational axis 180 of the control link 120 as set forth above. The eccentric camshaft 110 is provided with an eccentric cam 170 mounted thereon as an exemplary embodiment of the present invention. As the eccentric cam 170 rotates about a reference axis Y, the position of the eccentric camshaft 110 is changed in a case in which the eccentric cam 170 rotates. An engine control unit (not shown) determines a driving state of the engine based on signals received from respective sensors (not shown), and controls the rotation angle of the eccentric cam 170 and thus controls the vertical position of the rotational axis 180 of the eccentric camshaft 110 positioned at the other end of the eccentric camshaft 110 according to the driving state of the engine.

In the variable compression ratio apparatus according to the exemplary embodiment of the present invention, as shown in FIG. 1, the eccentric cam 170 of the eccentric camshaft 110 moves the rotational axis 180 of the control link 120 upwardly or downwardly in a case in which the eccentric cam 170 coupled to the eccentric camshaft 110 rotates. Therefore, as the eccentric camshaft 110 changes the vertical position of the other end of the control link 120 the control link 120 rotates about the other end thereof.

As described above, if the vertical position of the rotational axis 180 of the control link 120 changes, the trace of the links 120, 130, 140, and 150 and the connecting rod 160 changes and the compression ratio of the air-fuel mixture also changes.

In addition, the compression ratio of the air-fuel mixture may be changed by changing the length and shape of the division link 130, the support link 140 and the control link 120. The length and the shape of the division link 130, the support link 140, and the control link 120 can be easily changed according to target engine performance by a person of ordinary skill in the art.

Figure 2:
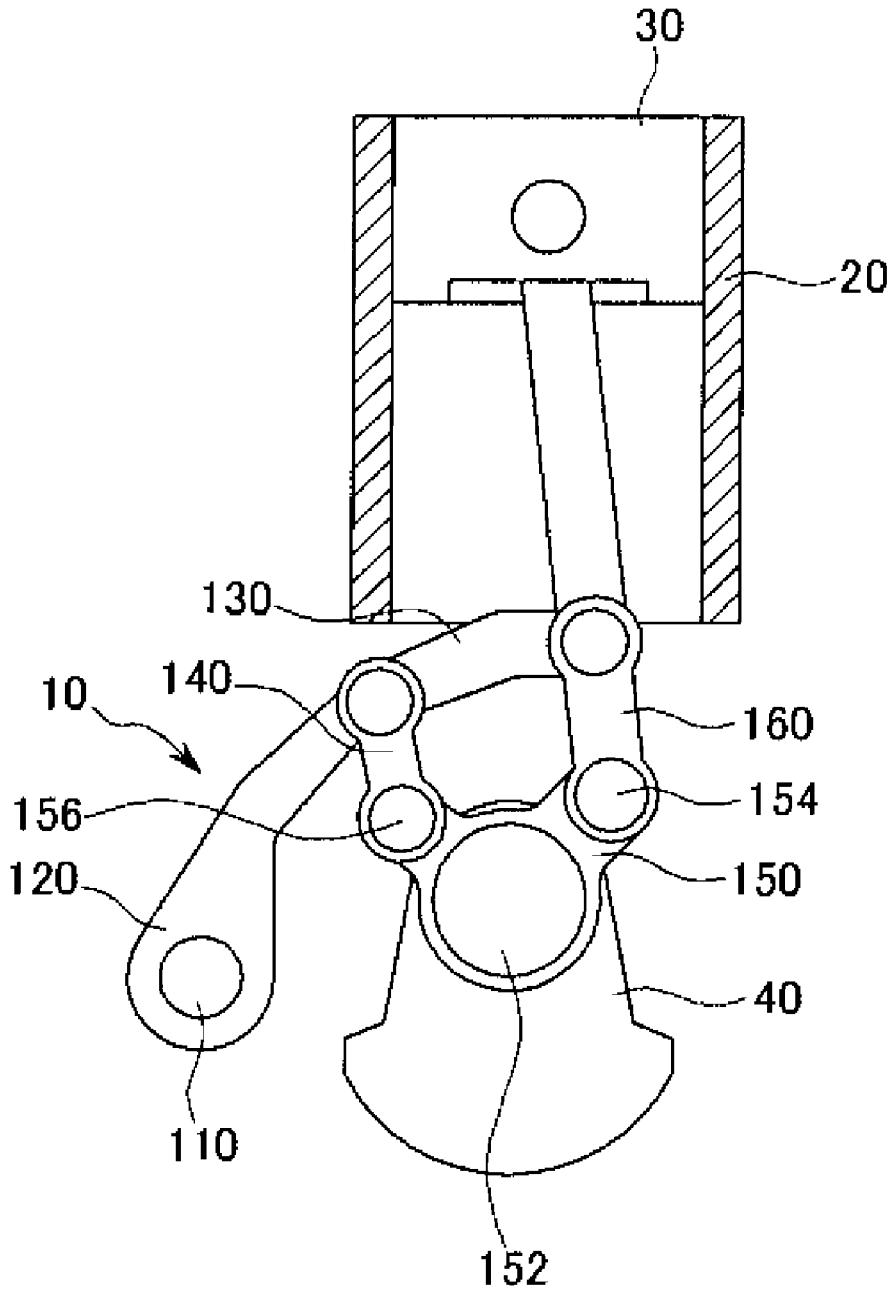
FIG. 2 is a schematic diagram of a variable compression ratio apparatus according to another exemplary embodiment of the present invention.

As shown in FIG. 2, a variable compression ratio apparatus according to another exemplary embodiment of the present invention is similar to the variable compression ratio apparatus according to the previous exemplary embodiment of the present invention as shown in FIG. 1.

In the variable compression ratio apparatus according to the current exemplary embodiment of the present invention, the control link 120 is integrally formed with the division link 130. Accordingly, the control link 120 is rotatably coupled with respect to the connecting rod 160, not the division link 130. However, the shape of the control link 120 and the division link 130 may be changed so as to operate similarly to the variable compression ratio apparatus shown in FIG. 1, and such a change can be easily performed by a person of ordinary skill in the art.

Figure 3:
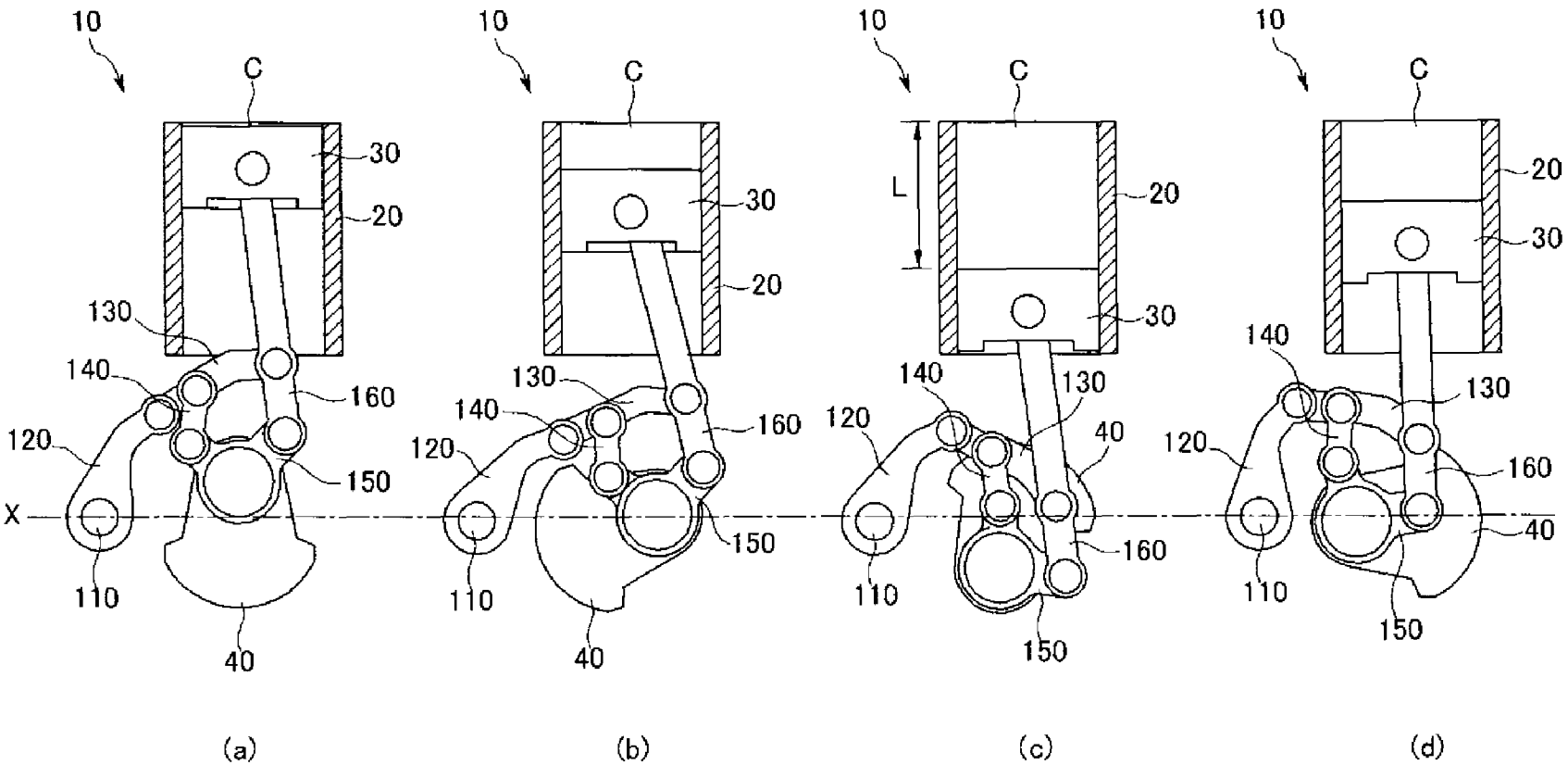
FIG. 3 is an operational diagram of a variable compression ratio apparatus according to an exemplary embodiment of the present invention which is operated in a state of a high compression ratio.

As shown in FIG. 3, if the rotational axis 180 of the control link 120 is located on a reference axis X, top dead center of the piston 30 is located high at the end of the compression stroke as shown in FIG. 3(*a*). Therefore, the volume C of the combustion chamber may be small, and thus the compression ratio of the air-fuel mixture may increase. In addition, a stroke L1 in a state of a high compression ratio, which is a distance between top dead center and bottom dead center, may be short as the bottom dead center is located high as shown in FIG. 3(*c*).

Figure 4:
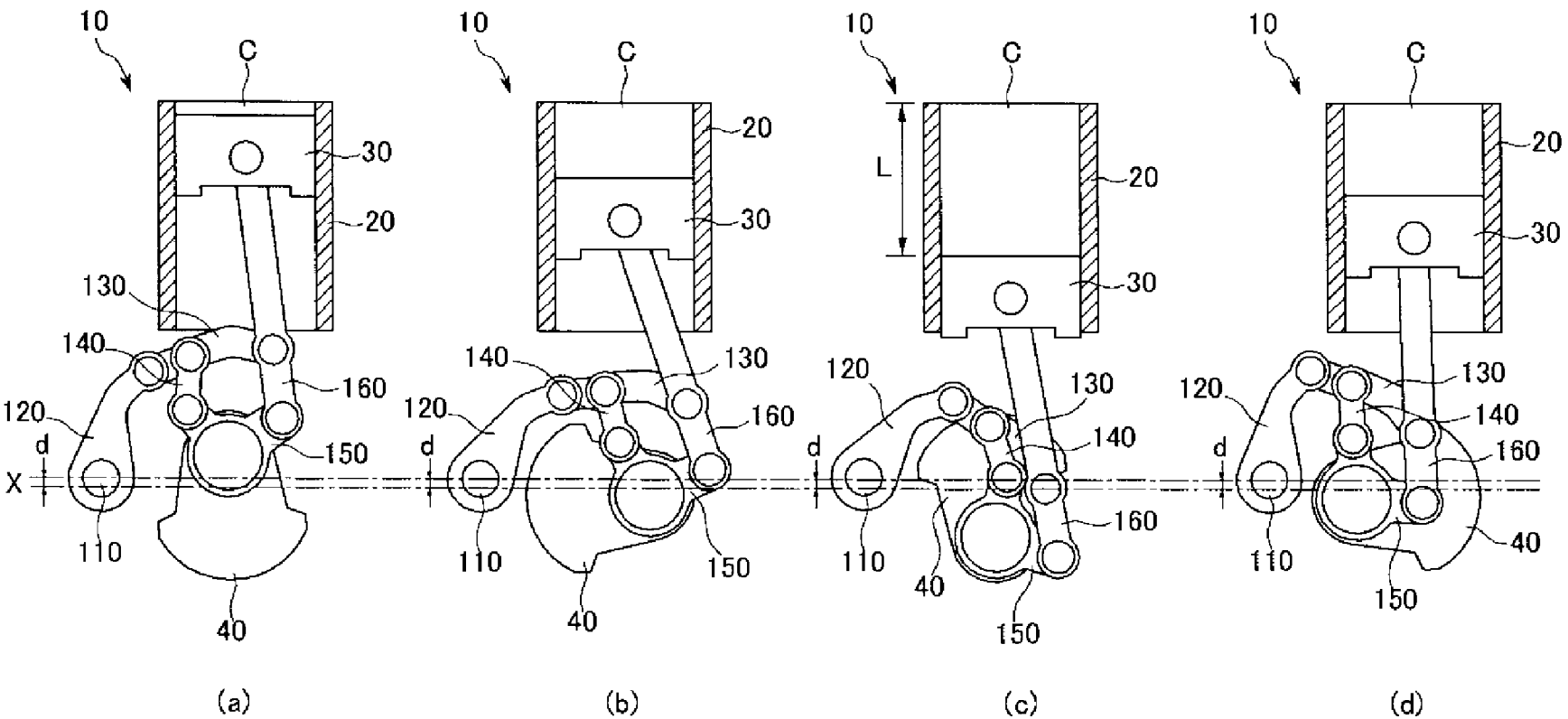
FIG. 4 is an operational diagram of a variable compression ratio apparatus according to an exemplary embodiment of the present invention which is operated in a state of a low compression ratio.

In contrast, as shown in FIG. 4(*a*), if the rotational axis 180 of the control link 120 is located higher than the reference axis X by a predetermined distance d, top dead center of the piston 30 is located lower at the end of the compression stroke, compared to the top dead center of the high compression ratio shown in FIG. 3(*a*). Therefore, the volume C of the combustion chamber may be larger than the volume of the combustion chamber in case of the high compression ratio, and thus the compression ratio of the air-fuel mixture may decrease. Further, since the bottom dead center of low compression ratio as shown in FIG. 4(*c*) is lower than the dead center of high compression ratio as shown in FIG. 3(*c*), the stroke L2 of low compression ratio may be longer than the stroke L1 of high compression ratio.

Figure 5:
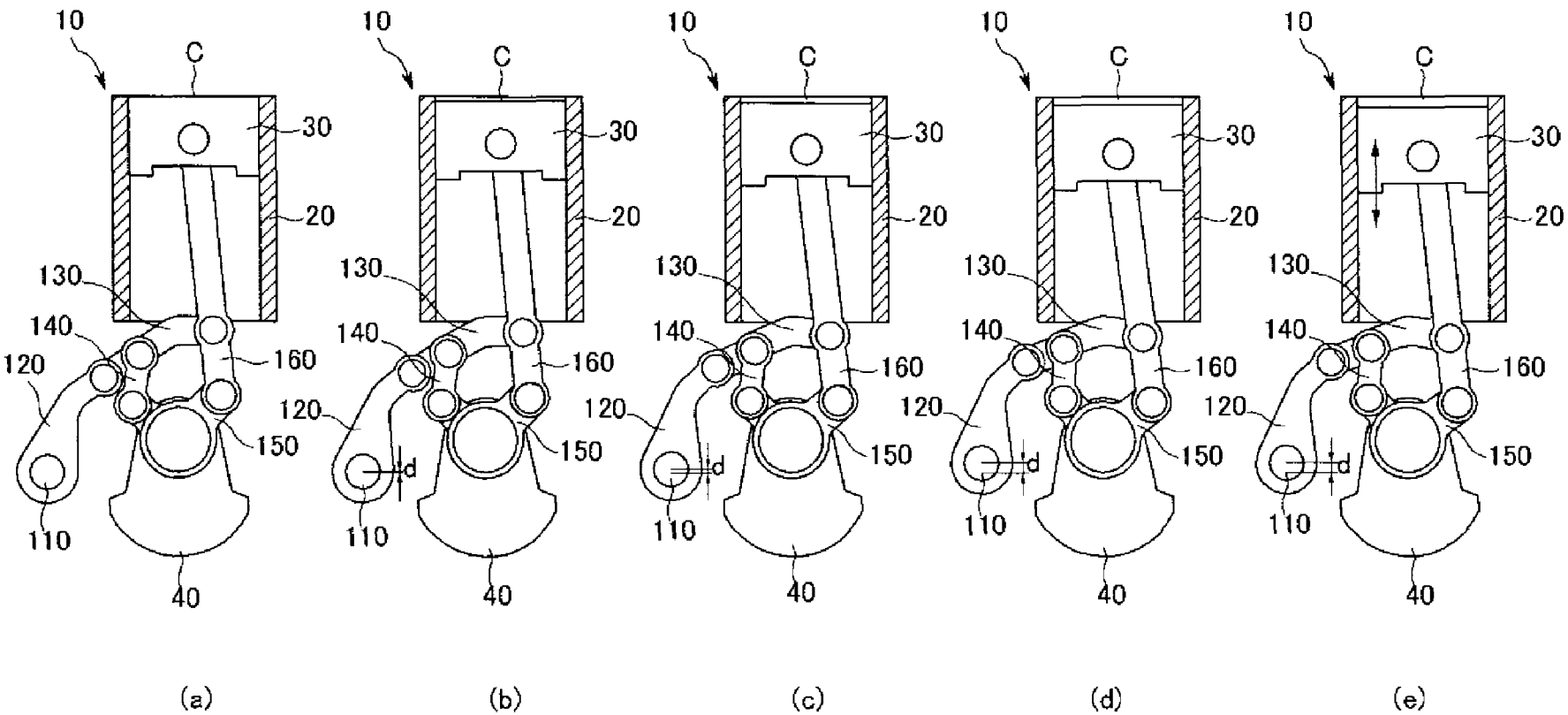
FIG. 5 shows increase in volume of a combustion chamber according to position change of a rotational axis of a control link in a variable compression ratio apparatus according to an exemplary embodiment of the present invention.
Figure 6:
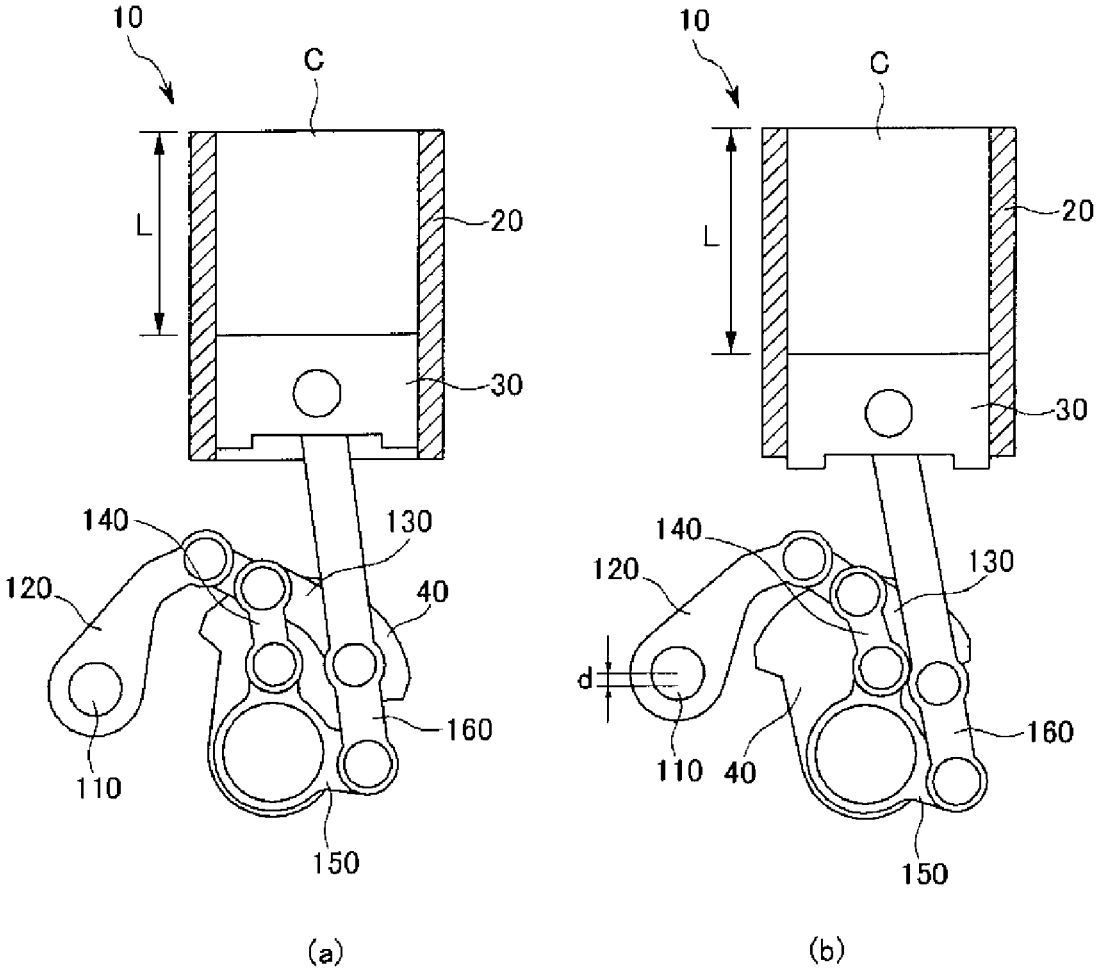
FIG. 6 shows a comparison of stroke in the states of high compression ratio and low compression ratio in a variable compression ratio apparatus according to an exemplary embodiment of the present invention.

FIG. 5 shows an increase in volume C of a combustion chamber according to position change of a rotational axis 180 of a control link in a variable compression ratio apparatus according to an exemplary embodiment of the present invention, and FIG. 6 shows a comparison of stroke in the states of high compression ratio and low compression ratio in a variable compression ratio apparatus according to an exemplary embodiment of the present invention.

As shown in FIG. 5, if the distance d between the reference axis X and the rotational axis 180 of the control link 120 becomes longer, top dead center of the piston 30 becomes lowered and the volume C of the combustion chamber becomes larger. Therefore, the compression ratio of the air-fuel mixture is decreased.

Further, as shown in FIG. 6, if the distance d between the reference axis X and the rotational axis 180 of the control link 120 becomes longer, the stroke between top dead center and bottom dead center becomes longer and exhaust amount is increased.

Figure 7:
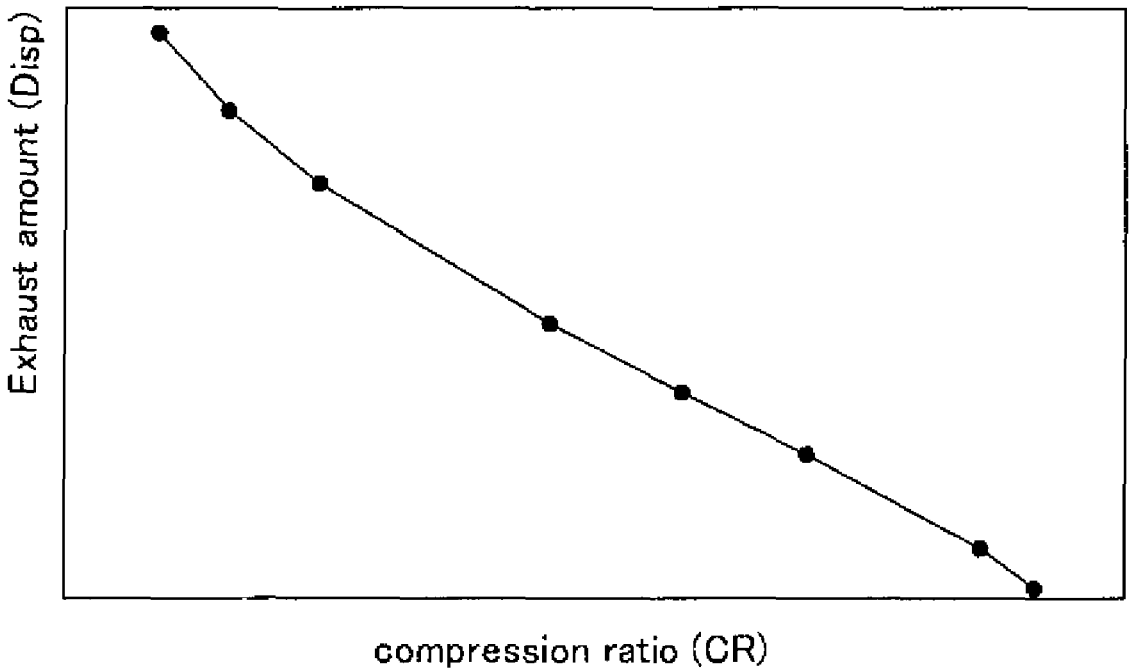
FIG. 7 is a graph showing a relationship between exhaust amount and compression ratio in a variable compression ratio apparatus according to an exemplary embodiment of the present invention.

FIG. 7 is a graph showing the relationship between exhaust amount and compression ratio in a variable compression ratio apparatus according to an exemplary embodiment of the present invention.

As shown in FIG. 7, the exhaust amount is inversely proportional to the compression ratio according to an exemplary embodiment of the present invention. Therefore, both the exhaust amount and the compression ratio can be controlled by changing the position of the rotational axis 180 of the control link 120 in the variable compression ratio apparatus according to the exemplary embodiment of the present invention.

Since the combustion force transmitted from a piston is distributed between a connecting rod and a support link, maximum stress applied to the connecting rod and the support link may be reduced according to a variable compression ratio apparatus of this invention. Therefore, manufacturing cost may be reduced and durability may improve.

In addition, since the control link is disposed substantially vertically next to a crankshaft, the volume of a crankcase may not need to be increased.

While this invention has been described in connection with what is presently considered to be practical exemplary embodiments, it is to be understood that the invention in not limited to the disclosed embodiments, but, on the contrary, is intended to cover various modifications and equivalent arrangements included within the spirit and scope of the appended claims.

What is claimed is:

1. A variable compression ratio apparatus for an engine delivering a combustion force from an air-fuel mixture through a piston and rotating a crankshaft, comprising:

a connecting rod receiving the combustion force from the piston;

a pin link receiving the combustion force from the connecting rod and rotating the crankshaft;

a support link disposed substantially in parallel with the connecting rod in order to transmit a part of the combustion force to the pin link;

a division link receiving a part of the combustion force from the connecting rod and transmitting the part of the combustion force to the support link;

a control link provided with one end coupled to the division link in order to change position of one end of the division link; and an eccentric camshaft coupled to other end of the control link in order to change a position of a rotational axis of the control link.

2. The variable compression ratio apparatus of claim 1, wherein the eccentric camshaft changes the compression ratio and exhaust amount of the air-fuel mixture by changing the vertical position of the other end of the control link.

3. The variable compression ratio apparatus of claim 1, wherein the control link is disposed substantially vertically next to the crankshaft.

4. The variable compression ratio apparatus of claim 1, wherein the compression ratio and the exhaust amount of the air-fuel mixture are changed by changing the length and shape of the division link and the support link.

5. The variable compression ratio apparatus of claim 1, wherein the control link and the division link are integrally formed with each other to be a single body.

6. The variable compression ratio apparatus of claim 1, wherein the eccentric camshaft is provided with an eccentric cam which rotation is controlled by an engine control unit.

7. A variable compression ratio apparatus for an engine delivering a combustion force from an air-fuel mixture through a piston and rotating a crankshaft, comprising:

a pin link provided with first, second, and third connecting points, the first connecting point being eccentrically and rotatably coupled to the crankshaft;

a connecting rod provided with two ends and a middle portion, one end thereof being rotatably coupled to the second connecting point of the pin link, and other end thereof being rotatably coupled to the piston;

a support link provided with two ends, one end thereof being rotatably coupled to the third connecting point of the pin link;

a division link provided with two ends and a middle portion, one end thereof being rotatably coupled to the middle portion of the connecting rod and the middle portion thereof being rotatably coupled to other end of the support link in order to transmit a part of the combustion force to the pin link;

a control link provided with two ends, one end thereof being rotatably coupled to other end of the division link; and an eccentric camshaft coupled to other end of the control link in order to change position of a rotational axis of the control link.

8. The variable compression ratio apparatus of claim 7, wherein the eccentric camshaft changes the compression ratio and exhaust amount of the air-fuel mixture by changing the vertical position of the other end of the control link.

9. The variable compression ratio apparatus of claim 7, wherein the first, second, and third connecting points are disposed in a predetermined triangular shape.

10. The variable compression ratio apparatus of claim 7, wherein the support link is disposed substantially in parallel with the connecting rod.

11. The variable compression ratio apparatus of claim 7, wherein the control link is disposed substantially vertically next to the crankshaft.

12. The variable compression ratio apparatus of claim 7, wherein the compression ratio and the exhaust amount of the air-fuel mixture are changed by changing the length and shape of the division link and the support link.

13. The variable compression ratio apparatus of claim 7, wherein the eccentric camshaft is provided with an eccentric cam which rotation is controlled by an engine control unit.

14. A variable compression ratio apparatus for an engine delivering a combustion force from an air-fuel mixture through a piston and rotating a crankshaft, comprising:

a pin link provided with first, second, and third connecting points, the first connecting point being eccentrically and rotatably coupled to the crankshaft;

a connecting rod provided with two ends and a middle portion, one end thereof being rotatably coupled to the second connecting point of the pin link, and other end thereof being rotatably coupled to the piston;

a support link provided with two ends, one end thereof being rotatably coupled to the third connecting point of the pin link;

a division link provided with two ends, one end thereof being rotatably coupled to the middle portion of the connecting rod, other end thereof being rotatably coupled to other end of the support link in order to transmit a part of the combustion force to the pin link;

a control link provided with two ends, one end thereof being integrally formed with the other end of the division link; and an eccentric camshaft coupled to other end of the control link in order to change position of a rotational axis of the control link.

15. The variable compression ratio apparatus of claim 14, wherein the eccentric camshaft changes the compression ratio and exhaust amount of the air-fuel mixture by changing the vertical position of the other end of the control link.

16. The variable compression ratio apparatus of claim 14, wherein the first, second, and third connecting points are disposed in a predetermined triangular shape.

17. The variable compression ratio apparatus of claim 14, wherein the support link is disposed substantially in parallel with the connecting rod.

18. The variable compression ratio apparatus of claim 14, wherein the control link is disposed substantially vertically next to the crankshaft.

19. The variable compression ratio apparatus of claim 14, wherein the compression ratio and the exhaust amount of the air-fuel mixture are changed by changing the length and shape of the division link and the support link.

20. The variable compression ratio apparatus of claim 14, wherein the eccentric camshaft is provided with an eccentric cam which rotation is controlled by an engine control unit.

* * * * *